US008347948B2

(12) United States Patent
Hu et al.

(10) Patent No.: US 8,347,948 B2
(45) Date of Patent: Jan. 8, 2013

(54) APPARATUS FOR PREPARING ALLOY SHEET

(75) Inventors: Boping Hu, Beijing (CN); Yizhong Wang, Beijing (CN); Xiaolei Rao, Beijing (CN); Jingdong Jia, Beijing (CN)

(73) Assignee: Beijing Zhong Ke San Huan High-Tech Co., Ltd., Beijing (CN)

( * ) Notice: Subject to any disclaimer, the term of this patent is extended or adjusted under 35 U.S.C. 154(b) by 110 days.

(21) Appl. No.: 12/668,511

(22) PCT Filed: May 28, 2008

(86) PCT No.: PCT/CN2008/071111

§ 371 (c)(1), (2), (4) Date: Jan. 19, 2010

(87) PCT Pub. No.: WO2009/006805

PCT Pub. Date: Jan. 15, 2009

(65) Prior Publication Data

US 2010/0186923 A1 Jul. 29, 2010

(30) Foreign Application Priority Data

Jul. 12, 2007 (CN) ..... 2007 1 0118723

(51) Int. Cl.
*B22D 11/00* (2006.01)

(52) U.S. Cl. ..... 164/423; 164/463

(58) Field of Classification Search ..... 164/423, 164/462–463, 427–430, 479–480
See application file for complete search history.

(56) References Cited

U.S. PATENT DOCUMENTS

| | | | | | |
|---|---|---|---|---|---|
| 4,154,283 | A * | 5/1979 | Ray et al. | ..... | 164/463 |
| 4,650,618 | A * | 3/1987 | Heinemann et al. | ..... | 264/431 |
| 4,794,977 | A * | 1/1989 | Iversen | ..... | 164/423 |
| 4,982,780 | A * | 1/1991 | Stepanenko et al. | ..... | 164/463 |
| 5,642,771 | A * | 7/1997 | Forest | ..... | 164/463 |
| 6,474,402 | B1 * | 11/2002 | Sauer et al. | ..... | 164/428 |
| 6,524,408 | B1 | 2/2003 | Schmitz et al. | | |
| 2002/0020514 | A1 * | 2/2002 | Arai et al. | ..... | 164/463 |

FOREIGN PATENT DOCUMENTS

| | | | |
|---|---|---|---|
| CN | 1634674 | A * | 7/2005 |
| JP | 61014049 | A * | 1/1986 |
| JP | 01218749 | A * | 8/1989 |

* cited by examiner

*Primary Examiner* — Kevin P Kerns
*Assistant Examiner* — Jacky Yuen
(74) *Attorney, Agent, or Firm* — Hammer & Associates, P.C.

(57) ABSTRACT

Apparatus for preparing alloy sheet, comprising a container for melted alloy liquid positioned in an inductive heating coil; a liquid flow stabilization outfit comprising a barrel container with open bottom and a base board arranged below the open bottom, and the barrel container's upper part being positioned below the mouth of the container for melted alloy liquid; a quenching wheel positioned below the melted alloy liquid flown from the liquid flow stabilization outfit's base board, which carries the melted alloy liquid and spins it into strips, to make the strips become alloy sheets after collision; a transferring outfit positioned below the wheel for further cooling and transferring of the alloy sheets, wherein the quenching wheel is equipped with a means for differentiating cooling rate for various alloy sheets. The magnetic material made of these alloy sheets is good in orientation, easy for post-sinter processing, and suitable for mass production.

2 Claims, 3 Drawing Sheets

-Prior Art-

APPARATUS FOR PREPARING ALLOY SHEET

FIELD OF THE INVENTION

The present invention relates to an apparatus for preparing alloy sheet. This apparatus can produce alloy sheets at various cooling rates using the same batch of melted alloy liquid, and can make the alloy sheets into proper metallurgical phase texture. The alloy sheets produced in this method, for example the rare earth-transition metal alloy sheets, can be used to produce permanent magnet material which is good in orientation, easy for post-sinter processing, and suitable for large-scale mass production.

The term "proper metallurgical phase texture" refers to that the size and orientation of main phase grains both meet the technical requirement, and the boundary phases distribute evenly around the main phase grains.

PRIOR ART

The applicant's Chinese patent ZL200310123402.2 discloses an apparatus and a process for producing alloy sheets by vacuum induction melting a kind of alloy composed of rare earth and other easily oxidized metals and multi-stage fast cooling, and then unloading the alloy sheets in batches.

As shown in FIG. 1, the top of a container 3 for melted alloy liquid is open. There is a flow guide groove at the brim of container in the dumping direction. The container 3 is usually a cylindrical crucible, and is positioned in an inductive heating coil.

Through an observation window of casting chamber, we can observe the diameter of liquid column and the height of liquid in the liquid flow stabilization set 4*a*, so as to adjust dumping speed in time to provide liquid to a cooling roller 5*a* nearly in a constant flow.

Liquid flow stabilization set is composed of two parts 4*a* and 4*b*. The part 4*a* is a barrel container with the bottom open, playing a role of guiding flow and controlling flow. The part 4*b* is positioned under the part 4*a* so that the liquid can flow freely, slow down and become even.

A roller 5*a* can move to and fro in the direction of axis. As the container 3 inclines, the liquid flow passes the part 4*a*, freely spreads at the bottom of the part 4*b*, and then equably and stably flows to the cooling roller 5*a*.

The alloy strips solidified on the surface of roller 5*a* separates from the surface by the centrifugal effect of the roller 5*a* (or the effect from scraper 6*b* arranged at the front edge of the roller 51). There is provided with a water cooling baffle 6*a* at the front of the falling alloy strips. The falling alloy strips is shattered into alloy sheets. There can be several baffles, when it is necessary, so that the strips can be shattered several times during the falling process.

The alloy sheets are collected by the transferring system 7 arranged below, and then transferred to the funnel-shaped collecting vessel 8. They are fully cooled during the process of transferring.

The alloy sheets dropped from the transferring system 7 get further shattered through the umbrella-shaped set positioned at the center of funnel-shaped collecting vessel 8. They are further cooled in the process of slipping to the bottom of funnel-shaped collecting vessel 8.

When the strips in the collecting vessel amount to certain quantity, a below pressure sensor gives a signal of unloading. The strips which have cooled down to a proper temperature are discharged to the container of outlet set 9, and then are transferred to the next procedure in batch, realizing the continual mass production.

It is obvious that the Chinese patent No. ZL200310123402.2 applied by the applicant has taken some measures to prevent the jam of liquid flow stabilization set 4*a*, and add into the funnel-shaped collecting vessel 8 and outlet set 9, by which the patent has greatly increased the productivity and decreased the fault rate of equipment.

The applicant has further discovered that a metallurgical phase texture (including grain size and its distribution, and phase distribution) of rapid solidified alloy strips is closely related with alloy cooling rate. This cooling rate sensitively depends on the rotating speed of the roller as well as its working surface material. To prevent a long time corrosion by high-temperature alloy liquid, the ordinary cooling roller is made of material with good thermal conductivity and is made to be with a small diameter. Therefore, it is necessary to strictly control the rotating speed.

SUMMARY OF THE INVENTION

The object of the invention is to provide an apparatus for preparing alloy sheets, which makes the rotating speed of quenching wheel adjustable at the relative large range and makes the cooling rate of the wheel easy to control, so as to obtain rapid solidified alloy sheets with ideal cooling rate and proper metallurgic phase texture.

Another object of this invention is to provide an apparatus for preparing alloy sheets, which obtains the proper metallurgical phase texture in the rapid solidified alloy sheets. The rare earth-transition metal alloy sheets produced by the process of the apparatus can be used for making permanent magnet materials which are good in orientation and easy for post-sinter processing.

Therefore, this invention provides an apparatus for preparing alloy sheet which comprises: a container for containing melted alloy liquid positioned in an inductive heating coil; a liquid flow stabilization outfit comprising a barrel container with an open bottom and a base board arranged below the open bottom, and the container's upper part being positioned below the mouth of the container for melted alloy liquid; a quenching wheel positioned to carry the melted liquid flown from the liquid stabilization outfit's base board, which swings the melted liquid as strips and the strips became an alloy sheet after collision; and a transferring outfit positioned below the quenching wheel for the further cooling and transferring of the alloy sheets, characterized in that the quenching wheel is with means for differentiating cooling rate for various alloy sheets.

Preferably, said means for differentiating cooling rate for various alloy sheets is a temperature controller which makes the quenching wheel's surface working temperature periodically change between room temperature and 700° C.

Preferably, said means for differentiating cooling rate for various alloy sheets is a temperature sub-zone outfit which divides the quenching wheel's surface into several regions with different working temperatures along the direction of rotation axis.

Preferably, said means for differentiating cooling rate for various alloy sheets is a variable speed controlling device which can continually adjust the rotating speed of the quenching wheel.

Preferably, said means for differentiating cooling rate for various alloy sheets is a surface layer of the quenching wheel, which has several regions in the direction of rotation axis, and the neighboring regions of which are made of different materials.

Preferably, said means for differentiating cooling rate for various alloy sheets is a quenching wheel which is shaped as a conical frustum, a ladder-shaped shaft, a waist drum, or a quenching wheel whose generatrix is of curve line or zigzag line.

Preferably, said ladder-shaped shaft quenching wheel's breadth is 2-10 cm, its ladder's fall is 0.5-5 cm. and the number of ladders is 5-25.

Preferably, said means for differentiating cooling rate for various alloy sheets is shaped as a rotating round disc or a round barrel with a perpendicular rotating axis, or a funnel shaped means with its generatrix of curve or zigzag line.

Preferably, the apparatus also includes the strip-collecting vessel under the transmitter.

Preferably, the apparatus also includes the outlet set under the collecting vessel.

The apparatus of preparing alloy sheets according to this invention makes the alloy sheets fully cooled before being unloaded to attain a suitable temperature. It is especially suitable for the production of easily oxidized rare earth alloy sheet.

In accordance with this invention, in the meanwhile of melting and casting, the previous produced alloy sheets are transferred to the next working procedure in batches, making the significant improvement of production efficiency possible.

According to this invention, the quenching wheel moves back and forth in the direction of axis, which results in the cyclic use of the its surface. This simplifies the liquid flow stabilization set and makes the working surface of the quenching wheel fully cooled, making it easier to produce the alloy sheets with a uniform thickness.

The apparatus of preparing alloy sheet according to this invention makes the alloy liquid of the same batch produce alloy sheet at different cooling rate, and makes the size and distribution of the sheet's grain suitable. The rare-earth transition-metal alloy sheets produced by this method can be made into the permanent magnet materials which are good in orientation, easy for processing, and suitable for large-scale mass production.

DETAILED DESCRIPTION OF THE EMBODIMENTS

With reference to these figures, an explanation will be given to several embodiments of the apparatus for preparing alloy sheets according to this invention.

Figure 1:
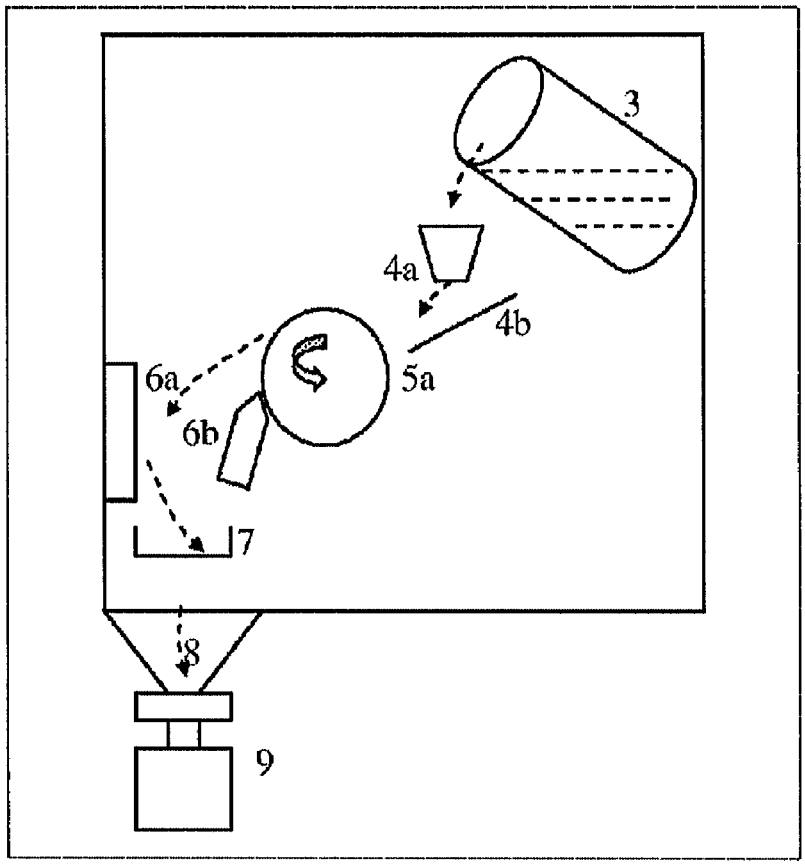
FIG. 1 is an illustration of the principle of the apparatus for preparing alloy sheets in accordance of the prior art.

The fundamental idea of this invention is, while keeping the efficiency of alloy sheet production, to make use of the quenching wheel (see the rotating barrel 5*a* in FIG. 1) with different physical parameters, so as to generate alloy sheet with different cooling rates for the same batch of alloy liquid. Because of different cooling rate, the alloy sheets can have different average grain size and size distribution, as well as a different metallurgic configuration and phase distribution, thereby the alloy sheets possess different mechanical features. Thus, after the alloy sheet being crushed into powder, the granularity is in suitable distribution and the ratio of the main phase to subsidiary phases can be adjusted. Therefore, the rare-earth transition-metal alloy sheet material produced by this method can be made into permanent magnets which is good in orientation, easy for post-sinter processing, and suitable for large-scale mass production.

It is easily understood for those skilled in the art that when the alloy sheets thrown out of the surface (see the roller 6*a* of the FIG. 1) of the quenching wheel (see the roller 5*a* of the FIG. 1), linear velocity cannot be too high (usually between about 0.5 m/s to about 15 m/s). Otherwise, the alloy sheets cannot properly crystallize or even become amorphous. On the other hand, the linear velocity cannot be too low to prevent the high-temperature metal liquid from damaging the surface of the quenching wheel.

The applicant's research demonstrates that with constant wheel surface temperature, and the thickness of alloy sheets being controlled between 0.1 to 0.4 mm the metallurgical phase structure of the alloy sheet can be controlled in the case of various rotation speeds. Under the other condition of constant quenching wheel's rotation speed, alloy sheets with different phase texture can also be produced by controlling the surface temperature of the quenching wheel.

Therefore, in the first embodiment of the present invention, the surface working temperature of the quenching wheel can be controlled to change periodically between room temperature and 700° C., which makes the cooling rate change accordingly. Thus, the produced alloy sheets' metallurgical phase textures are different and the produced alloy sheets' mechanical performances are different. The machinability of the magnet made of the alloy sheets can be improved.

Similarly, in accordance with the variant embodiment of the first embodiment of this invention, the rotation speed of the quenching wheel can be made to continually change, namely the rotation speed can be made to gradually increase and then decrease without interruption, making the cooling rates of alloy sheets different in a single production period. Thus, the alloy sheets with proper metallurgic phase texture can be obtained, and the mechanical performances of the sheets are different, thereby the machinability of the magnet made of the alloy sheets is improved.

Figure 2:
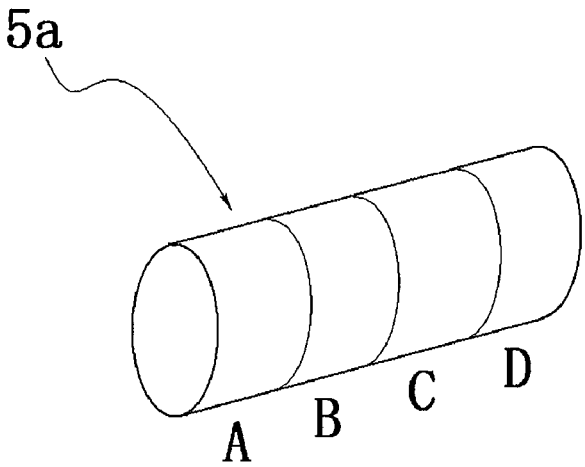
FIG. 2 is an illustration of the temperature or material sub-zone distribution of the quenching wheel according to an embodiment of this invention.
Figure 3:
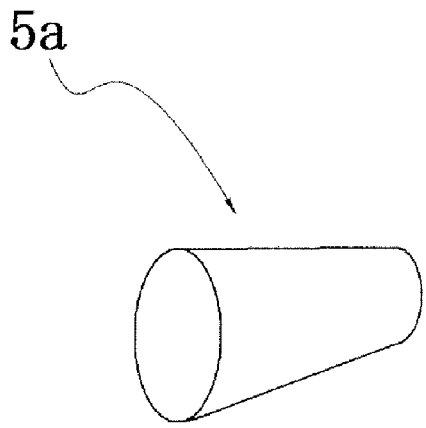
FIG. 3 is an illustration of the conical frustum shaped quenching wheel according to this invention.

Similarly, in accordance with another variant embodiment of the first embodiment of this invention, the surface of the quenching wheel is divided into several regions of various working temperature (see regions A, B, C, and D in FIG. 2). The temperature of each working temperature region can be set from the room temperature to 700° C. This may make the alloy sheets produced at the same time have different thickness and different cooling rate. Thus, the alloy sheets with proper metallurgic phase texture can be obtained, and the mechanical performances of the sheets are different, thereby the machinability of the magnet made of the alloy sheets is improved.

According to the second embodiment of this invention, in order to make the cooling rate of the alloy sheets different, the quenching wheel's working surface can be made of materials with different thermal conductivity along the rotation axis. The quenching wheel's surface can be divided into several regions (see regions A, B, C, and D in FIG. 2), and each material region is made of Ti, V, Cr, Fe, Co, Ni, Cu, Al, Zr, Nb, Mo, Ta, W, Pd, Au, Pb, stainless steel, gun barrel steel, cannon barrel steel, high temperature steel, or other high-temperature resistant alloy. This also makes the thickness of the alloy sheets produced at the same time different and their cooling rate different. Thus, the alloy sheets with proper metallurgic phase texture can be obtained, and the mechanical performances of the sheets are different, thereby the machinability of the magnet made of the alloy sheets is improved.

According to the third embodiment of this invention, for a requirement of preparing alloy sheet with proper grain size distribution, the working surface of the quenching wheel can be in the shape of a conical frustrum. Thus, in the condition of constant rotation speed of the quenching wheel, the alloy sheets in different axial position of the conical frustrum have different thrown out linear velocity, which can also make the alloy sheets' cooling rate different, thus preparing alloy sheets with proper metallurgic phase texture.

Figure 4:
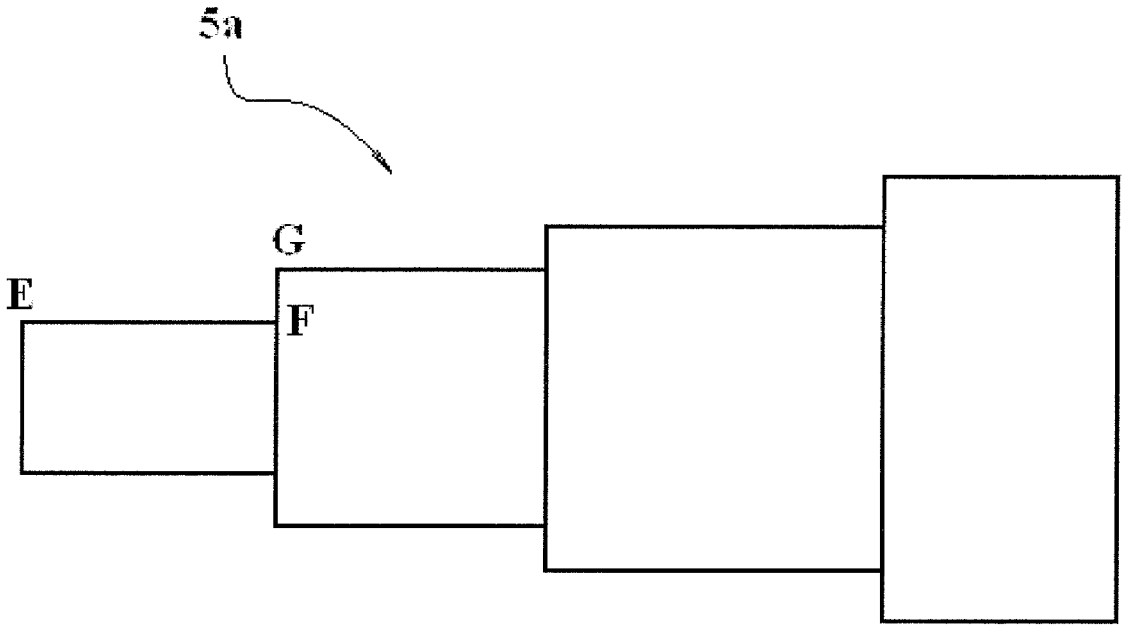
FIG. 4 is an illustration of the ladder shaped shaft quenching wheel according to this invention.

According to the fourth embodiment of the invention, in order to make the cooling rate of the alloy sheets different, the working surface of the quenching wheel can be in the shape of ladder along its axis (See FIG. 4). For example, ladder width from E to F can be 2-10 cm, the ladder fall from F to G can be 0.5-5 cm, and the quenching wheel can have 5-25 steps (FIG. 4 only shows 3 steps as an example). Thus, in the condition of constant rotation speed of the quenching wheel, the alloy sheets in different position of the ladder along the axis have different thrown out linear velocity, which can also makes the alloy sheets' cooling rate different, thus preparing alloy sheets with proper metallurgic phase texture.

Figure 5:
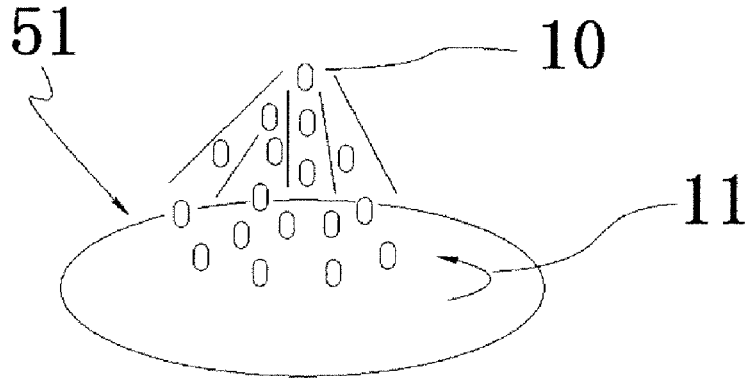
FIG. 5 is an illustration of the round plate shaped quenching wheel according to this invention.

According to the fifth embodiment of this invention, in order to make the cooling rate of the alloy sheets different, a rotating plate 51 can be used to replace with the quenching wheel (see FIG. 5). Thus, in the condition of constant rotation speed of the plate 51 (see the arrow 11 in FIG. 5), the alloy sheets 10 in different radius position have different thrown out linear velocity, so that the cooling rate of preparing alloy sheets is different, so as to obtain alloy sheets with proper metallurgic phase texture.

According to a variant embodiment of the fifth example of this invention, the surface of the rolling disk 51 can be flat, or it can have grooves along the axial or radial direction.

Figure 6:
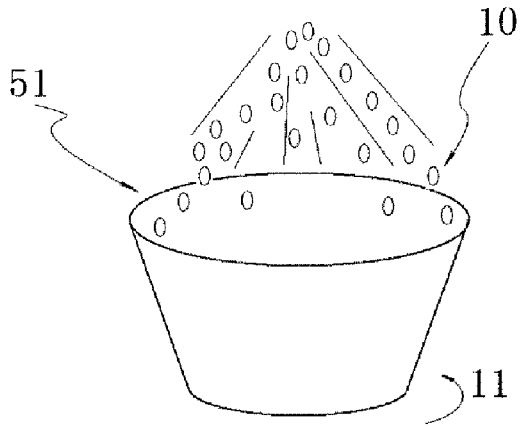
FIG. 6 is an illustration of the round barrel shaped quenching wheel according to this invention.

According to the sixth embodiment of this invention, in order to make the cooling rate different, the quenching wheel can be replaced by a rotating barrel 51. For example, the sidewall's gradient is from 5-45°. Thus, in the condition of constant rotation speed of the barrel 51 (see the arrow 11 in FIG. 6), the alloy sheets 10 at different radius position have different cooling time in the barrel, which also makes the alloy sheets' cooling rate different, thus preparing alloy sheets with proper metallurgic phase texture.

According to a variant embodiment of the sixth embodiment of this invention, the rotating barrel 51 can also have the sidewall whose generatrix is in zigzag line.

Figure 7:
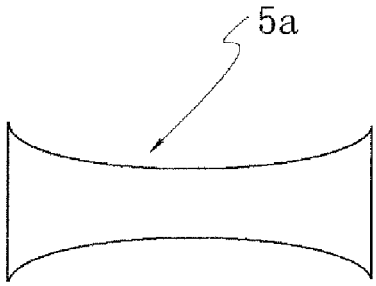
FIG. 7 is an illustration of an embodiment of the quenching wheel whose generatrix is a curve according to this invention.
Figure 8:
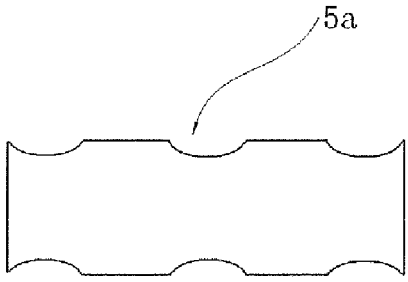
FIG. 8 is an illustration of an embodiment of the quenching wheel whose generatrix is a zigzag line according to this invention.

Through the above explanation, those skilled in the art can easily think of other embodiments by understanding the idea of the invention. For example, as shown in FIG. 7, the generatrix can be in the shape of curve or waist drum. As shown in FIG. 8, the quenching wheel's generatrix can have several grooves on circumference. And it can also be in the shape of curve which changes periodically, for example a sine curve.

This invention is applicable not only for the production of rare-earth transition-metal alloy, rare earth permanent magnet material, and hydrogen storage material, but also applicable for other alloy materials, such as iron based and nickel based materials.

In one word, those skilled in the art can make amendments, changes, replacements, perfections, and improvements, etc. according to the disclosure of this invention. However, this will not go beyond the spirit of this invention and the scope of protection of the claims.

The invention claimed is:

1. An apparatus for preparing alloy sheet from a melted alloy liquid comprising:

a first container for melted alloy liquid with a mouth which is positioned in an inductive heating coil;

a liquid flow stabilization outfit comprising a barrel container with open bottom and an upper part, and a base board arranged below the open bottom, and the upper part being positioned below the mouth of the container;

a quenching wheel arranged to carry the melted alloy liquid from the base board and to spin the melted alloy liquid into strips that become alloy sheets after collision; and a transferring outfit positioned below the quenching wheel for further cooling and transferring of the alloy sheets, characterized in that the quenching wheel comprises a cooling surface shaped as a stepped shaft having a number of segments separated by steps, the number of steps ranges from 5-25, a step height ranges from 0.5-5 cm, a length of one of the segments ranges from 2-10 cm, and wherein a diameter of each segment sequentially increases from one end of the quenching wheel to another end of the quenching wheel.

2. The apparatus as claimed in claim 1, characterized in that the apparatus further comprises a strip-collecting vessel arranged below the transferring outfit and an outlet set arranged below the collecting vessel.

* * * * *